US005452598A

United States Patent [19]

Cheng

[11] Patent Number: 5,452,598

[45] Date of Patent: Sep. 26, 1995

[54] AUTOMATIC SPRING FORMATION APPARATUS

[75] Inventor: Ming-Yih Cheng, Taoyuan, Taiwan, Prov. of China

[73] Assignee: Minyu Machinery Corp., Ltd., Taiwan, Prov. of China

[21] Appl. No.: 95,513

[22] Filed: Jul. 26, 1993

[51] Int. Cl.[6] ..... B21F 3/027; B21F 35/02

[52] U.S. Cl. ..... 72/12; 72/137; 72/138; 72/140; 72/450

[58] Field of Search ..... 72/10, 135, 137, 72/138, 140, 141, 145, 146, 441, 446, 450, 12

[56] References Cited

U.S. PATENT DOCUMENTS

| | | | |
|---|---|---|---|
| 3,906,766 | 9/1975 | Sato | 72/138 |
| 4,587,821 | 5/1986 | Sykes | 72/137 |
| 4,893,491 | 1/1990 | Ohdai et al. | 72/138 |
| 4,947,670 | 8/1990 | Wu | 72/138 |
| 5,127,247 | 7/1992 | Baisch | 72/138 |

FOREIGN PATENT DOCUMENTS 129967 3/1990 Taiwan, Prov. of China .

*Primary Examiner*—Lowell A. Larson
*Assistant Examiner*—Thomas C. Schoeffler
*Attorney, Agent, or Firm*—Spencer, Frank & Schneider

[57] ABSTRACT

An automatic spring formation apparatus includes a base on which an upright work table is mounted. A number of linear motion spring formation tools and at least a curved motion spring formation tool are slidably mounted on the front working surface to work on a wire fed through a wire feed passage formed on the work table so as to form a spring by being driven by independent servo motors under the control of a computerized numeric control unit. The linear motion spring formation tools are movable on the front working surface in a linear way along a radial direction pointing out from the wire feed passage while the curved motion spring formation tool is not only linearly movable on the front working surface along a radial direction pointing out from the wire feed passage, but also rotatable about a pivot normal to the working surface so as to move in a combination of linear translation and angular rotation.

20 Claims, 10 Drawing Sheets

AUTOMATIC SPRING FORMATION APPARATUS

FIELD OF THE INVENTION

The present invention relates generally to an automatic spring formation apparatus and in particular to a computerized numeric control (CNC) spring formation apparatus.

BACKGROUND OF THE INVENTION

Automatic spring forming machines are known. For example, Taiwanese patent publication No. 129967 discloses a CNC spring forming machine which is shown in FIGS. 10 and 11 of the attached drawings. This prior art spring forming machine comprises a wire feed device to feed a length of wire into the spring forming machine to be worked on by a plurality of spring formation tools which are mounted on separate tool slides to be driven and controlled by cam devices under the control of a microcomputer control unit. A gear transmission system is provided to drive the cam devices. The microcomputer control unit controls the movements of the tools and the feed of the wire to form springs with the spring formation tools in a automatic manner. This provides an automatic, high efficiency spring forming machine.

One of the disadvantages of such a prior art spring forming machine structure is that the movement of the tools A (FIG. 11), the speeds and the dead intervals thereof are all controlled by the cam devices B (FIG. 11). A change in the manufacturing process requires changeover and trial-and-error tests of new cam devices. This complicates the manufacturing of springs of different types, especially for small quantity, great variety manufacturing. Further, such a prior art machine structure only allows the spring formation tools to move or feed in a linear manner within a tool holder C (FIG. 11) and no curved motion of the tools is possible. This limits the capability of the spring forming machine.

It is therefore desirable to provide a spring formation apparatus which overcomes the above-mentioned deficiencies.

SUMMARY OF THE INVENTION

The principal objective of the present invention is to provide an automatic spring formation apparatus wherein the spring formation tools are independently driven by servo motors via suitably-designed linkage so as to provide great manufacturing flexibility.

It is also an objective of the present invention to provide an automatic spring formation apparatus which includes both a curved motion spring formation tool and a linear motion spring formation tool to provide manufacturing flexibility for springs of different types, especially for small quantity, great variety manufacturing.

It is a further objective of the present invention to provide an automatic spring formation apparatus with a CNC unit to allow quick switching between different manufacturing processes of different type springs.

To achieve the above objectives, there is provided an automatic spring formation apparatus comprising a base on which an upright work table is mounted. A number of linear motion spring formation tools and at least a curved motion spring formation tool are slidably mounted on the front working surface to work on a wire fed through a wire feed passage formed on the work table so as to form a spring by being driven by independent servo motors under the control of a computerized numeric control unit. The linear motion spring formation tools are movable on the front working surface in a linear way along a radial direction pointing out from the wire feed passage while the curved motion spring formation tool is not only linearly movable on the front working surface along a radial direction pointing out from the wire feed passage, but also rotatable about a pivot normal to the working surface so as to move in a combination of linear translation and angular rotation.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
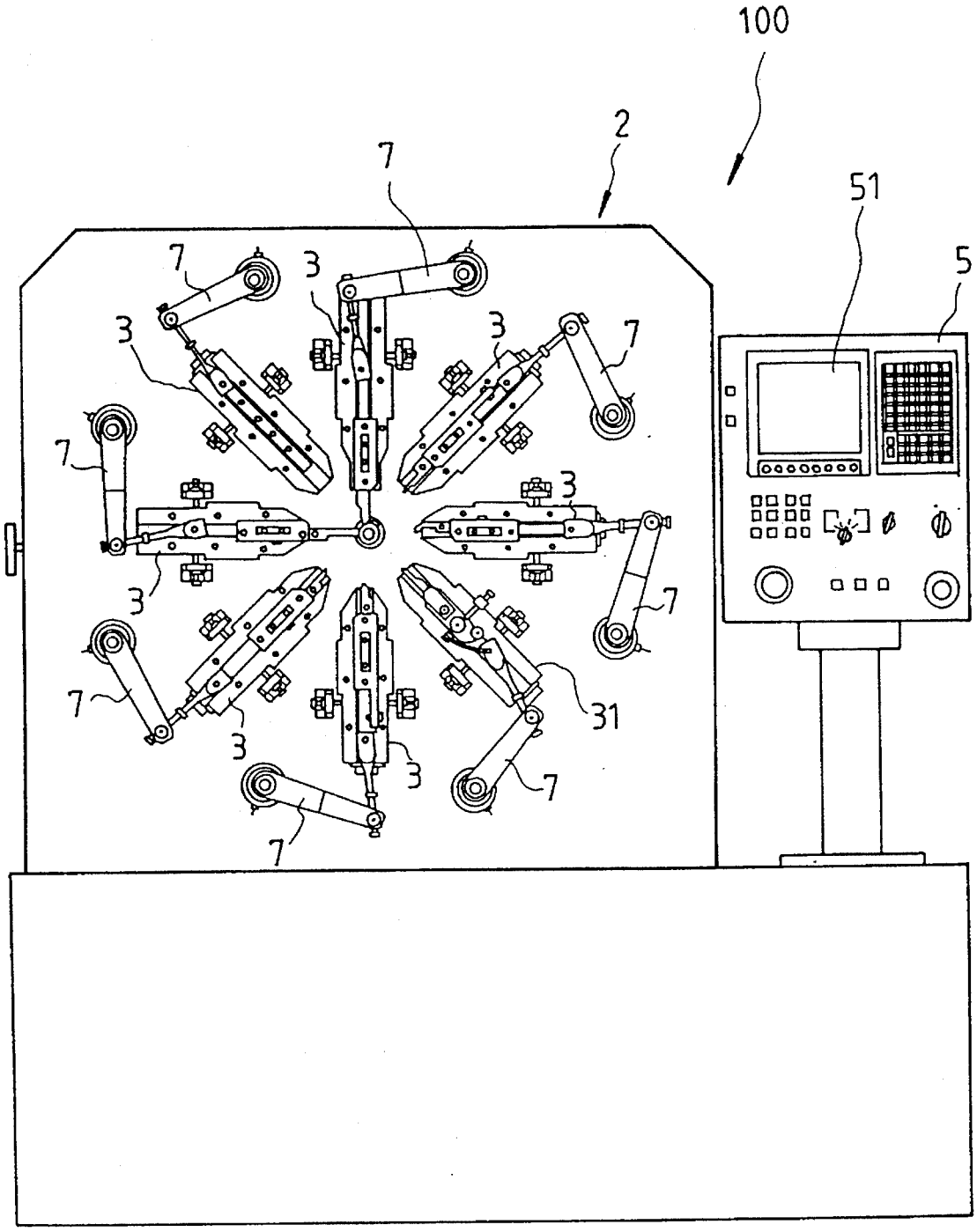
FIG. 1 is a front side view of an automatic spring formation apparatus constructed in accordance with the present invention.

With reference to the drawings and in particular to FIG. 1, wherein an automatic spring formation apparatus constructed in accordance with the present invention, generally designated by the reference numeral 100, is shown, the automatic spring formation apparatus 100 comprises a base 1 on which an upright work table 2 is standing. The work table 2 has a front working surface 22 on which a plurality of linear motion spring formation tool sets 3, for example seven in the embodiment illustrated, and at least a curved motion spring formation tool set 3' are movably mounted. Both of the linear motion spring formation tool sets 3 and the curved motion spring formation tool set 3' will be generically referred to as spring formation tool sets or, more simplified, tool sets hereinafter.

Figure 8:
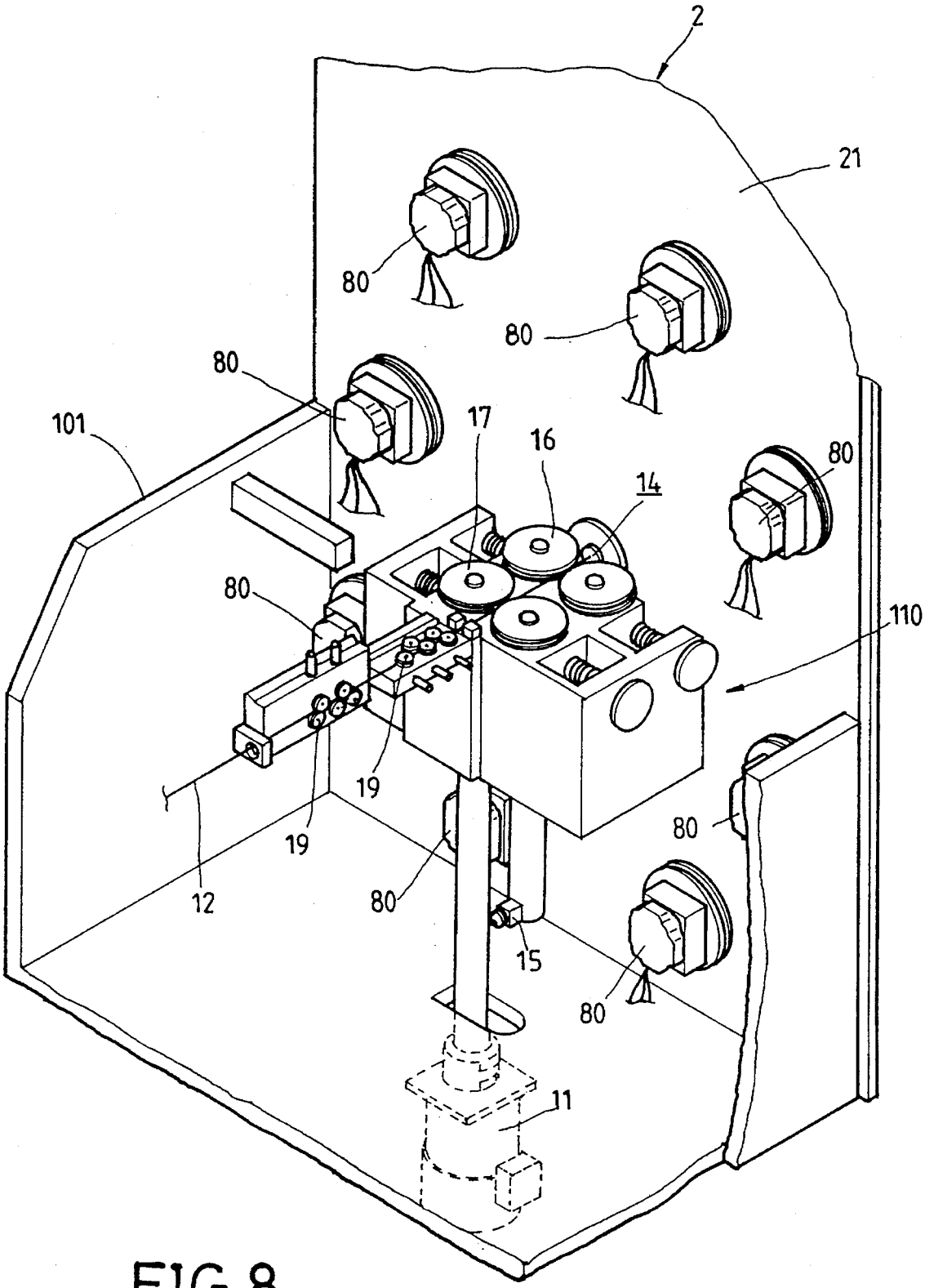
FIG. 8 is a perspective view showing a wire feed device of the spring formation apparatus.

On the rear side 21 of the work table 2, opposite to the front working surface 22 thereof, wire feed means 110 (see FIG. 8) is mounted and enclosed in a housing 101 (FIG. 8).

The spring formation apparatus 100 of the present invention further comprises a control unit 5 which in the embodiment is preferably a computerized numeric control (CNC) unit to control the operation and movement of the parts and elements of the spring formation apparatus 100. As known to those skilled in the art of computerized numeric control, the CNC unit 5 comprises a processing unit (not shown) operated by a program which may be built therein in advance or stored in separate memory means to control the spring formation apparatus in accordance with the desired manufacturing processes. The CNC unit 5 may also have a monitor screen 51 to monitor the operation of the spring formation apparatus 100.

Figure 9:
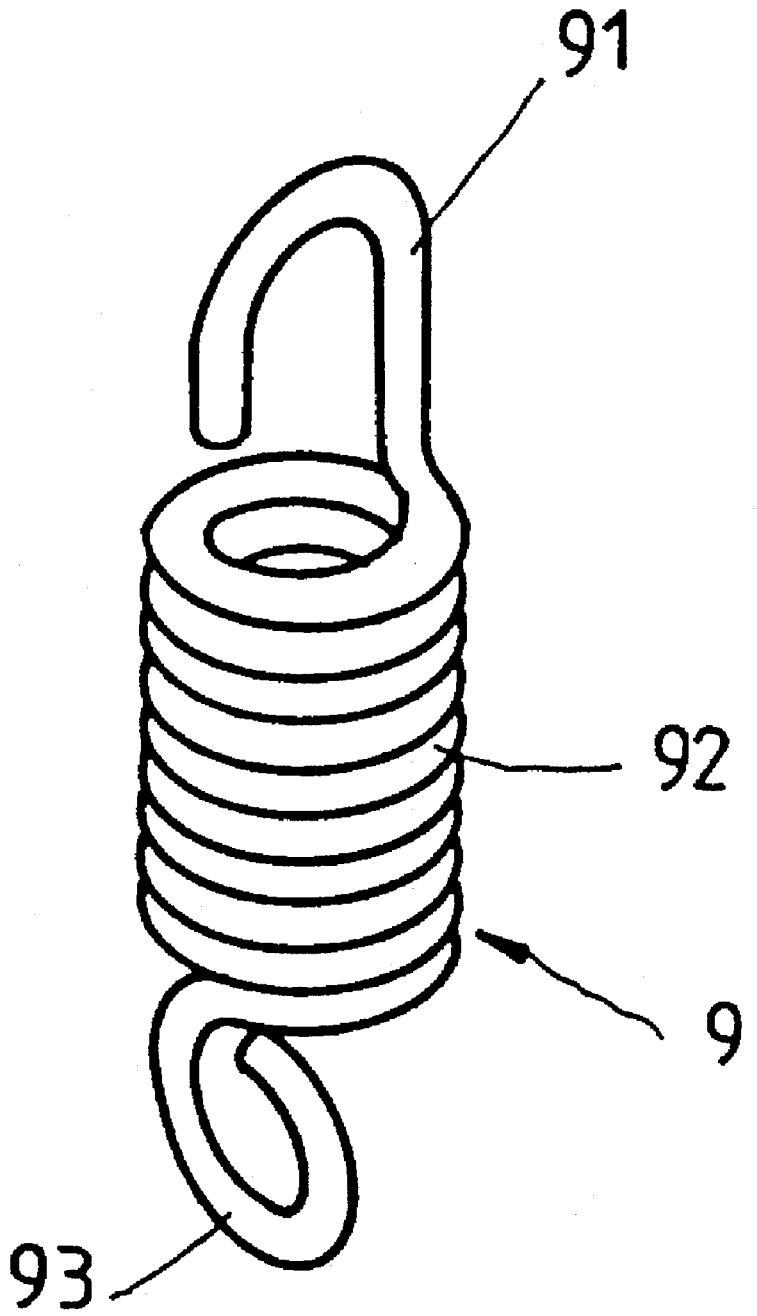
FIG. 9 is a perspective view showing a spring manufactured by the spring formation apparatus of the present invention.
Figure 10:
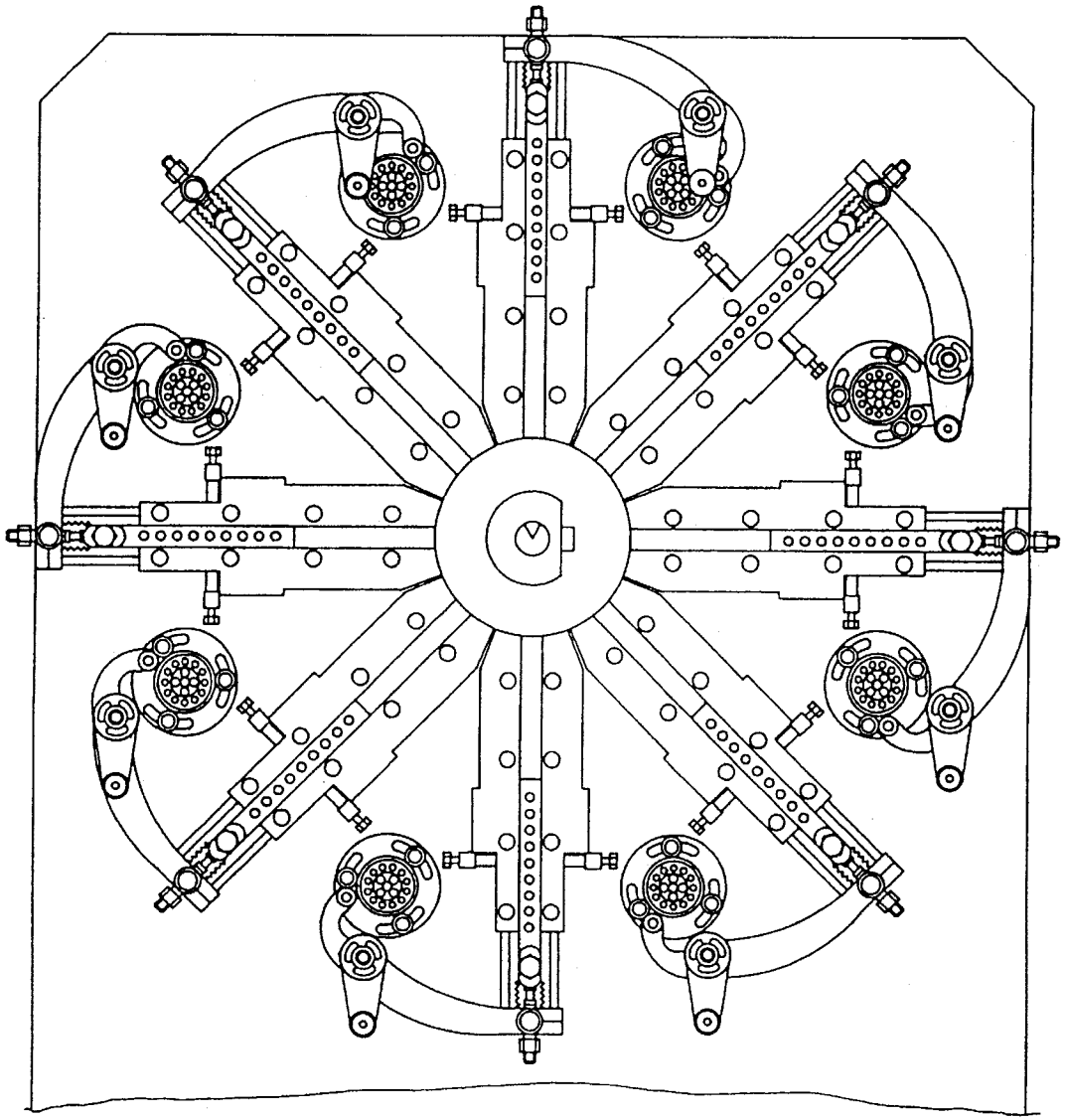
FIG.10 PRIOR ART
FIG. 10 is a front side view showing a portion of a prior art spring forming machine.
Figure 11:
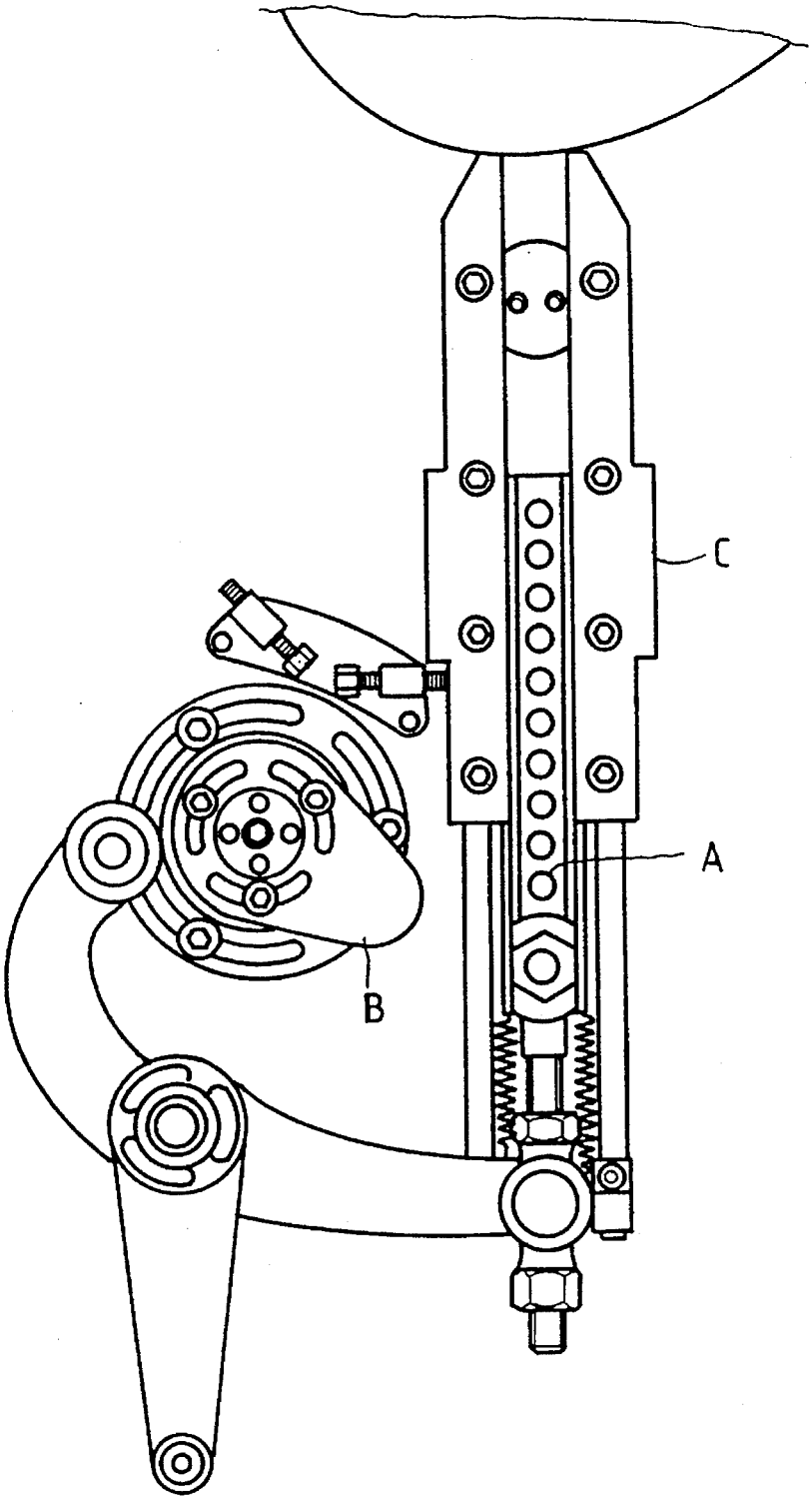
FIG.11 PRIOR ART
FIG. 11 is a front side view showing the tool sets of the prior art spring forming machine.

Each of the linear motion spring formation tool sets 3 comprises a tool seat 31 with a linear motion spring formation tool 60 slidably mounted thereon to be driven by a servo motor 80 (FIG. 8) associated therewith via a linkage 7 so as to form a spring 9, an example of which is shown in FIG. 9, under the control of the CNC unit 5. Similarly, the curved motion spring formation tool set 3' comprises a tool seat 31 on which a curved motion spring formation tool 60' is slidably mounted thereon to be driven by a servo motor 80 (FIG. 8) associated therewith via a linkage 7 so as to form the spring 9 (FIG. 9) under the control of the CNC unit 5. The linear motion spring formation tool 60 and the curved motion spring formation tool 60' will also be referred to as linear motion tool 60 and curved motion tool 60' for abbreviation hereinafter.

Figure 2:
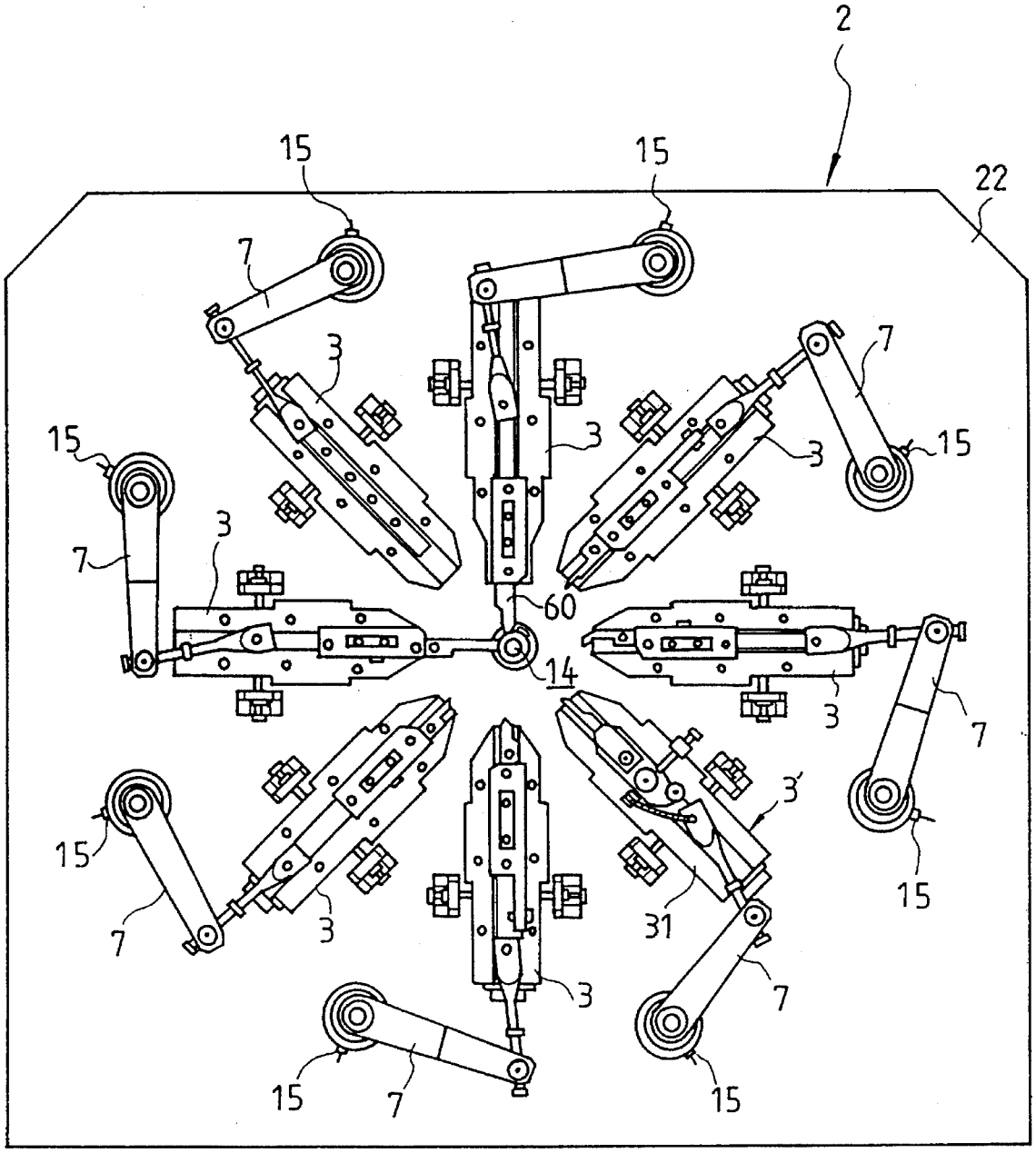
FIG. 2 is a front side view of the spring formation tool sets of the spring formation apparatus shown in FIG. 1.
Figure 3:
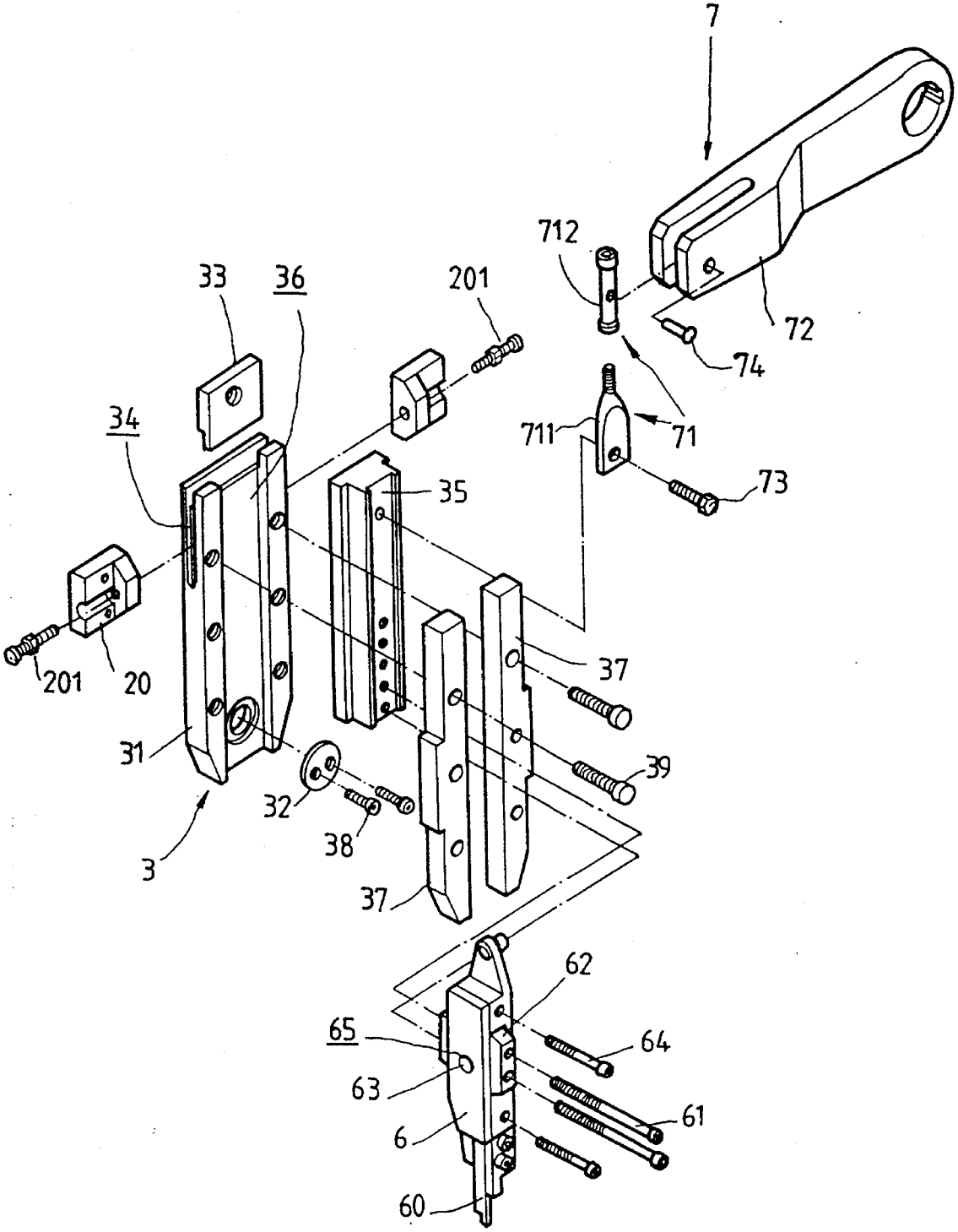
FIG. 3 is an exploded perspective view of a linear motion spring formation tool set of the spring formation apparatus of the present invention.

The structure of the linear motion tool sets 3 is more clearly shown in FIGS. 2 and 3. Each of the linear motion tool sets 3 comprises a tool seat 31 pivotally mounted on the front working surface 22 of the work table 2 about a circular disk member 32. The circular disk member 32 is fixed to the work table 2 by suitable fasteners, such as screws 38 illustrated in FIG. 3. A retaining member 33 is secured on the working surface 22 of the work table 2 to slidably retain the linear motion tool seat 31 on the front working surface 22.

On each of two opposite edges of the tool seat 31, a slot 34 is formed to receive therein a tip of a threaded guiding pin 201 which is threadedly received within an inner-threaded block 20 secured to the front working surface 22 juxtaposing the edge of the tool seat 31 to allow the tool seat 31 to be rotated about the circular disk member 32 by adjusting the threaded guiding pin 201. Thus, the orientation of the linear motion tool 60 can be changed by adjustment of the guiding pins 201.

A tool slide 35 is slidably received within a slide channel 36 formed on the tool seat 31 by a pair of securing plates 37 which are secured to the tool seat 31 by means of, for example, screws 39 to allow the tool slide 35 to be slidable within the slide channel 36 in a linear manner.

Figure 4:
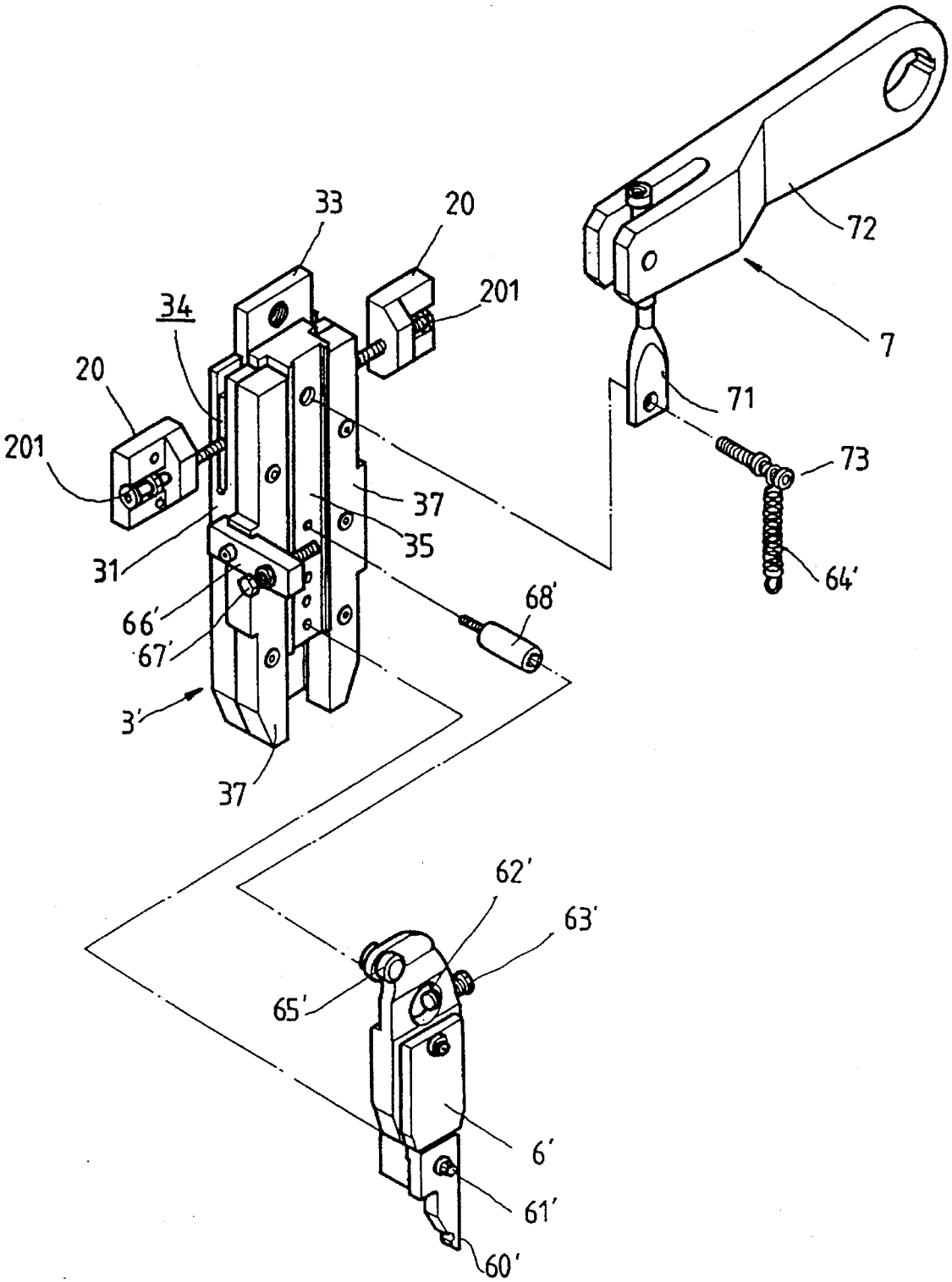
FIG. 4 is an exploded perspective view of a curved motion spring formation tool set of the spring formation apparatus of the present invention.

The tool slide 35 is driven by the servo motor 80 via the linkage 7 connected therebetween. As shown in FIGS. 3 and 4, the linkage 7 comprises a first link member 71 which has a first section 711 and a second section 712 threadedly connected together to provide a length-adjustable member with one end thereof, for example the first section 711, pivoted to the tool slide 35 by a pin member 73 for moving the tool slide 35 within the slide channel 36. The linkage 7 further comprises a second link member 72 which is secured to a driving shaft 81 of the servo motor 80 at one end thereof and pivoted to the second section 712 of the first link member 71 by a pivot 74 at the opposite end thereof so as to allow the servo motor 80 to move the tool slide 35 and thus the linear motion tool 60 by actuating the first and second link members 71 and 72.

The length adjustable structure of the first link member 71 allows the user to adjust the geometrical relationship between the second link member 72 and the tool slide 35.

Preferably, speed reduction means, such as a reduction gear train (not shown), is provided between the servo motor 80 and the driving shaft 81.

The linear motion tool 60 is fixed on a tool holder 6 which is secured to the tool slide 35 by a pivoting block 62. The pivoting block 62 is fixed to the slide tool 35 by fasteners, such as screws 61, with pivot pins 63 thereof which extend therefrom along a direction substantially normal to the central axis of the disk member 32 and the sliding direction of the tool slide 35 rotatably received within holes 65 formed on the tool holder 6 so as to allow the tool holder 6 to be rotatable relative to the tool slide 35 to change the included angle therebetween.

Two screws 64 are provided to secure the tool holder 6 at a specific orientation relative to the pivoting block 62 and thus the tool slide 35.

The structure of the curved motion tool set 3' is shown in FIG. 4. Similar to the linear motion tool set 3, the curved motion tool set 3' comprises a tool seat 31 which is rotatable about a circular disk member 32 fixed on the work table 2. Also, a retaining member 33 is secured to the working surface 22 of the work table 2 to slidably retain the curved motion tool set 3' thereon. The curved motion tool set 3' has also two slots 34 formed on opposite edges thereof for respectively receiving therein a tip of a threaded guiding pin 201 threadedly secured in an inner-threaded block 20 fixed on the work table 2 for adjusting the curved motion tool set 3'. Similarly, a tool slide 35 is retained on the tool seat 31 by securing plates 37 in a slidable manner.

The curved motion tool set 3' differs from the linear motion tool set 3 in that the curved motion tool holder 6' is pivotally mounted to the tool slide 35 by a pivot 61' with a pivoting axis thereof substantially parallel with the central axis of the circular disk 32 to allow the curved motion tool holder 6' to be rotatable relative to the tool slide 35. The curved motion tool holder 6' has a roller 65' rotatably attached thereto at an upper end thereof. A biasing spring 64' is connected between the first link member 71 of the linkage 7, such as on the pin 73 which connects the first link member 71 to the tool slide 35, and a sideward lug 63' of the curved motion tool holder 6' to bias the roller 65' toward a side block 66' which is fixed on the curved motion tool seat 31 so that when the curved motion tool 60' is moved to pass over the side block 66', the roller 65' is contactable by a sideward projection 67' of the side block 66' to rotate the curved motion tool holder 6' about the pivot 61' against the biasing spring 64'. This provides the curved motion tool holder 6' with a motion of a combination of linear translation and angular rotation particular useful in forming the close-looped end portion of the spring 9 shown in FIG. 9.

The curved motion tool holder 6' further has a through hole 62' formed thereon for receiving therein a cylindrical post member 68' which has a diameter smaller than that of the through hole 62' so as to allow the curved motion tool holder 6' to be rotatable or swingable about the pivot 61' within a limited angular range determined by the clearance between the post member 68' and the through hole 62'.

As shown in FIG. 2, the spring formation apparatus 100 of the present invention comprises a plurality of servo motors 80, each corresponding to one of the spring formation tools 60 and 60'. The number of the servo motors 80 is eight in this embodiment, for the spring formation tools are eight in number. Each of the servo motors 80 drives a driving shaft 81 to actuate the linkage 7 connected thereto for moving the respective spring formation tool. In the embodiment illustrated, there are in total eight linkages 7, seven of which drive the seven linear motion tool sets 3 and the eighth driving the curved motion tool set 3'. As illustrated in FIG. 8, the servo motors 80 are mounted to the rear side 21 of the work table 2 and enclosed by a housing 101 (only a portion of which is shown in FIG. 8) with the driving shafts 81 extending through the work table 2 to the front working surface 22 thereof. As mentioned previously, speed reduction gear trains may be connected between the servo motors 80 and the driving shafts 81 to provide a desired output speed to the driving shafts 81.

Figure 6:
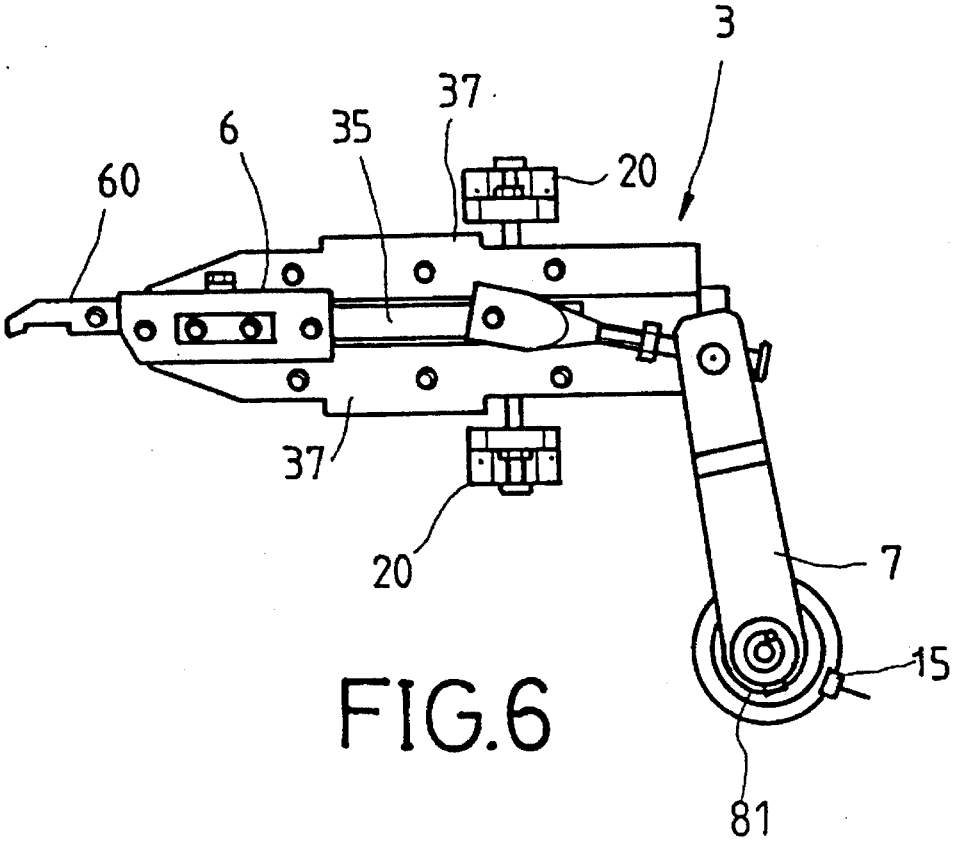
FIG. 6 is a front side view showing the operation of the linear motion spring formation tool.

The operation of the linear motion tools 60 is illustrated in FIG. 6. The rotation of the driving shaft 81 drives the linkage 7 to move the tool slide 35 within the slide channel 36 in a linear way. This moves the linear motion tool 60 toward or away from a wire feed passage 14 formed on the work table 2 through which a wire or other line material used to manufacture the spring 9 is fed into the apparatus 100.

In the embodiment illustrated, a counter clockwise rotation of the driving shaft 81 causes the linear motion tool 60 to approach the wire feed passage 14 and a clockwise rotation of the driving shaft 81 makes the linear motion tool 60 move away from the wire feed passage 14, both along a direction extending from the wire feed passage 14.

Figure 7:
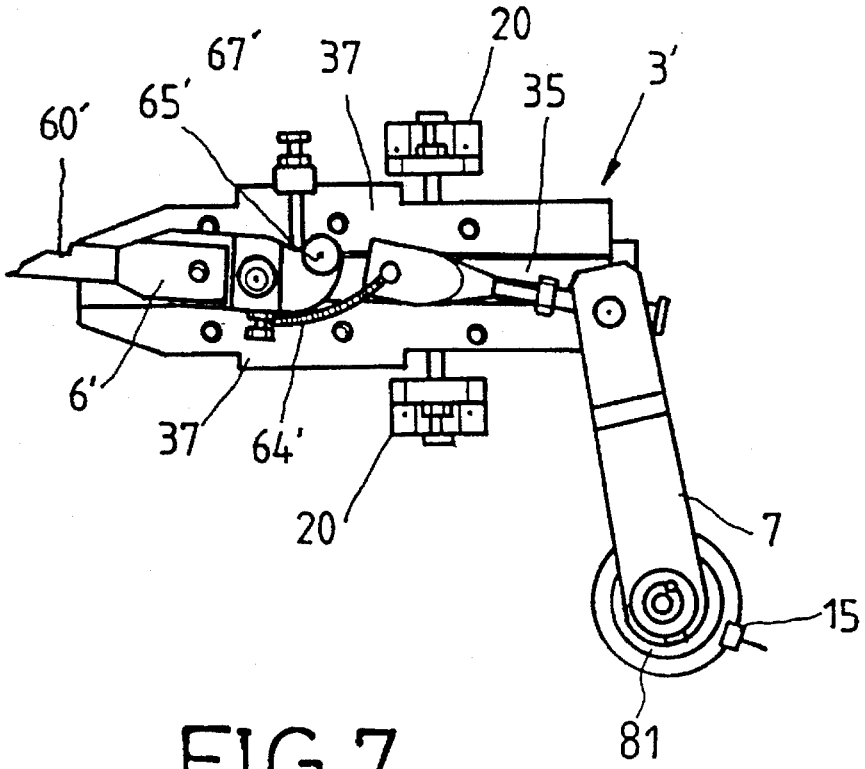
FIG. 7 is a front side view showing the operation of the curved motion spring formation tool.

The operation of the curved motion tool 60' is illustrated in FIG. 7. Similar to the case of the linear motion tool 60, the rotation of the driving shaft 81 will cause the tool slide of the curved motion tool 60' to move within the slide channel 36 thereof toward or away from the wire feed passage 14 along a direction extending from the wire feed passage 14. The curved motion tool 60' when starting from the farthest position away from the wire feed passage 14 is moved in a linear manner until the roller 65' of the tool holder 6' comes into contact engagement with the sideward projection 67' of the side block 66'. The contact engagement between the roller 65' and the sideward projection 67' of the side block 66' rotates the curved motion tool holder 6' about the pivot 61' and deforms the biasing spring 64' so as to provide the curved motion tool 60' with a combined motion of linear translation along the slide channel 36 and angular rotation about the pivot 61'.

A further movement toward the wire feed passage 14 moves the roller 65' out of contact engagement with the sideward projection 67' of the side block 66' and allows the curved motion tool 60' to resume its linear translation motion along the slide channel 36 by the biasing force of the spring 64'.

In the embodiment shown in the drawings, a counterclockwise rotation of the driving shaft 81 moves the curved motion tool 60' toward the wire feed passage 14 to work on the wire 12 fed therethrough and a clockwise rotation brings the curved motion tool 60' away from the wire feed passage 14.

The servo motors 80 are independently controlled by the CNC unit 5 to rotate the driving shafts 81 by specified angular displacements at a desired timing schedule. Preferably, a sensor 15 (FIGS. 2, 6 and 7), such as a photo angular speed transducer, is affixed to each of the driving shafts 81 for applying the rotational speed of the driving shafts 81 to the CNC unit 5 to be converted to a linear displacement for displaying in the monitor screen 51 of the CNC unit 5.

The CNC unit 5 controls the servo motors 80 to move the spring formation tools 60 and 60' in a desired sequence to work on the wire 12 fed through the wire feed passage 14 for forming the spring 9. By the magnificent flexibility in the manufacturing process provided by the CNC unit 5, springs of different shapes and specifications can be formed automatically by the spring formation tools 60 and 60' under the control of the CNC unit 5. This is particularly good for a small quantity, great variety manufacturing procedure.

Although in the illustrated embodiment, the spring formation tools 60 and 60' are distributed in an equally-spaced manner around the wire feed passage 14, it is understood that other arrangements which achieve the formation of the spring 9 from the wire 12 is also included in the scope of the present invention. It should also be noted that although there is only one curved motion tool 60' disposed at the bottom right orientation of the front working surface 22 of the work table 2, it is possible to dispose the curved motion tool 60' at any of the locations of the linear motion tools 60 to interchange with the linear motion tool 60 and the number of the curved motion tool 60' can be more than one, if desired.

The wire feed means 110 adopted in the automatic spring formation apparatus 100 of the present invention will be now described with reference to FIG. 8. The wire feed means 110 is disposed inside the housing 101 mounted to the rear side 21 of the work table 2 for feeding the wire 12 through the wire feed passage 14 formed on the work table 2.

Inside the housing 101, the wire 12 is guided to pass through the wire feed passage 14 by at least one pair of mated feed rollers, for example two pairs 16 and 17, which are driven by a motor 11 and coupled together by gears (not shown) so as to move the wire 12 through the wire feed passage 14 by the pinching engagement thereof with the wire 12. A sensor 15 is mounted to the rotational axis of one of the feed rollers 16 and 17 for detecting the angular speed thereof and the detection result is transferred to the CNC unit 5 to be displayed on the screen 51 for monitoring the operation thereof and to serve as a control parameter to the CNC unit 5 for controlling the servo motors 80.

Preferably, idle rollers 19 are provided inside the housing 101 to help guide the feed of the wire 12.

Figure 5:
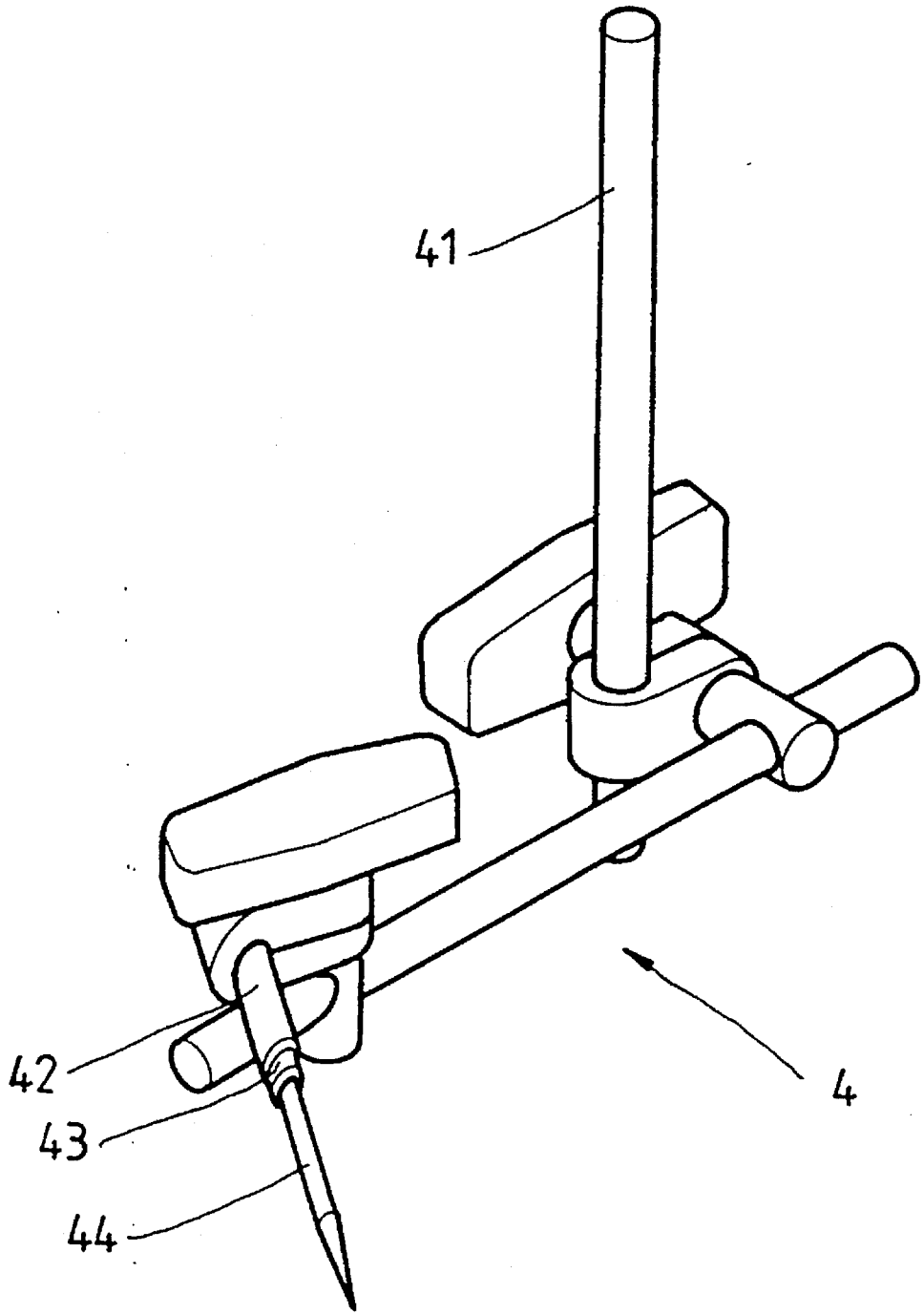
FIG. 5 is a perspective view showing a spring length detection device used in the spring formation apparatus of the present invention.

Preferably, a detection device 4 is provided as shown in FIG. 5 for detecting the length of the spring 9 which is being manufactured by the automatic spring formation apparatus 100. The detection device 4 comprises a stand 41 secured on the work table 2 and a pneumatic cylinder 42 mounted to the stand 41 to be movable along the length of the stand 41. The pneumatic cylinder 42 comprises an axially-movable shaft 43 on which an electrically-conductive probe 44 or spring supports of other types are mounted. The contact between the probe 44 and the spring 9 which is being manufactured induces a signal for determination of the length of the spring 9.

The action of the pneumatic cylinder 42 is controlled by the CNC unit 5 via a solenoid valve connected thereto to cooperate with the spring formation action of the spring formation tools 60 and 60' during the manufacturing of the spring 9.

The spring formation process provided by the automatic spring formation apparatus 100 of the present invention will be now described with reference to the spring 9 shown in FIG. 9 which is only an example of the spring products that can be manufactured by the automatic spring formation apparatus 100 of the present invention and the description is illustrative only, not to limit the present invention.

The spring 9 has a helically-wound body 92 with a hooked end 91 and a close-looped end 93. The manufacturing process for the hooked end 91 is done by bending the wire 12 three times under the control of the CNC unit 5. The feed of the wire 12 is controlled by the CNC unit 5. Once the wire 12 has been fed in a desired length, the feed of the wire 12 is stopped. The spring formation tools are then moved toward the wire 12 at a selected orientation, tool feed depth and sequence under the control of the CNC unit 5 to form the desired hooked end 91.

The formation of the helically-wound body 92 of the spring 9 is done by a tool having an inclined forming surface. The tool is moved to a desired location to allow the wire 12 which is continuously fed to be bent at a constant angle provided by the inclined forming surface by contact engagement therebetween. The external diameter of the spring 9 is determined by the feed angle of the wire 12 relative to the inclined forming surface and the geometry of the inclined surface of the tool.

The formation of the close-looped end 93 is provided by bending the wire 12 several times and using the curved motion tool 60' to close the loop 93. This cannot be done with the conventional spring forming machines.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed s:

1. A spring formation apparatus comprising:

a base;

a work table standing on said base in an upright manner, having a front working surface and a rear side opposite to said front working surface, said rear side being enclosed by a housing, said work table having formed thereon a wire feed passage through which a wire used to form a spring of a desired length by said apparatus is fed along a first direction from the rear side of the work table to the front working surface of said work table;

a plurality of servo motors disposed inside said housing each having a respective driving shaft;

a plurality of linear motion tool sets each mounted on the front working surface of said work table and each comprising:

a linear motion tool slidable on said front working surface along a radial direction extending from the wire feed passage between a first position away from said wire feed passage and a second position close to said wire feed passage, said linear motion tool being engageable with the wire fed through said wire feed passage at the second position;

a tool seat rotatably mounted on said front working surface about a circular disk member having an axis normal to said front working surface, said tool seat having a slide channel to receive therein a tool slide which is retained within said slide channel by securing plates, said tool slide being slidable within said slide channel along the radial direction thereof;

a mechanical connection between said tool slide and the driving shaft of the respective servo motor for moving said tool slide between the first position and the second position, comprising a linkage having:

a first link member constituted by a first section pivotally fixed to said tool slide, and a second section in thread engagement with the first section to form a length adjustable structure therebetween; and a second link member having a first end pivoted to the second section of the first link member, and a second end pivoted to the driving shaft so that when the driving shaft is rotated by the respective servo motor, said tool slide is moved within said slide channel by the linkage; and a tool holder which is secured to said tool slide to be movable therewith, said tool holder having a pivoting block with the linear motion tool fixed thereon and pivotally secured thereto to allow said linear motion tool to rotate relative to said tool holder about a pivoting axis being substantially normal to both the radial direction and the first direction; and a curved motion tool set mounted on the front working surface of said work table, comprising a curved motion tool linearly slidable on said working surface along a radial direction extending from the wire feed passage between a first position away from said wire feed passage and a second position close to said wire feed passage, said curved motion tool being engageable with the wire fed through said wire feed passage at the second position, said curved motion tool being also rotatable about a pivot normal to said front working surface between a third position and a fourth position so as to be movable in a combined motion of linear translation and angular rotation; said servo motors respectively driving said linear motion tools and said curved motion tool by the respective driving shafts thereof, said servo motors being actuatable so as to move said linear motion tools and said curved motion tool between their respective first positions and second positions thereof;

wire feed means for feeding the wire from the rear side of the work table through said wire feed passage and to the front working surface of said work table; and a control unit for controlling the feed of the wire from the rear side of the work table to the front working surface and for controlling the movements of said linear motion tools and said curved motion tool in accordance with a preset procedure and sequence to form the spring from the wire.

2. A spring formation apparatus as claimed in claim 1, wherein said control unit comprises a computerized numeric control unit for controlling the feed of said wire and the actuation of said servo motors in accordance with the pre-set working procedure.

3. A spring formation apparatus as claimed in claim 1, wherein said linear motion tool set comprises a pair of inner-threaded blocks disposed in the proximity of two opposite edges of said tool seat, each inner threaded block having a threaded guiding pin threadedly received therein to have a tip of a respective guiding pin received within a slot formed on each of the opposite edges of the tool seat for adjusting said tool seat in a rotatable manner about said circular disk member.

4. A spring formation apparatus as claimed in claim 1, wherein said curved motion tool set comprises:

a tool seat rotatably mounted on said front working surface about a circular disk member having an axis normal to said front working surface, said tool seat having a slide channel to receive therein a tool slide which is retained within said slide channel by securing plates, said tool slide being slidable within said slide channel along the radial direction thereof;

a tool holder which is rotatably secured to said tool slide to be movable therewith and rotatable relative thereto about a pivot normal to said front working surface, said tool holder having a curved motion tool fixed thereon at a lower end thereof and a roller rotatably attached thereto at an upper end thereof; and a biasing spring being connected between said tool holder and said tool slide to bias said roller to be contactable by a side block secured to said tool seat and thus rotating said tool holder about the pivot to provide a combined motion of linear translation and angular rotation to said curved motion tool, said tool slide being mechanically connected to the driving shaft of the respective servo motor to be driven thereby for moving between the first position and the second position thereof.

5. A spring formation apparatus as claimed in claim 4, wherein said curved motion tool set comprises a pair of inner-threaded blocks disposed in the proximity of two opposite edges of said tool seat, each inner threaded block having a threaded guiding pin threadedly received therein to have a tip of a respective guiding pin received within a slot formed on each of the opposite edges of the tool seat for adjusting said tool seat in a rotatable manner about said circular disk member.

6. A spring formation apparatus as claimed in claim 4, wherein said mechanical connection between said tool slide and the driving shaft of the respective servo motor comprises a linkage having:

a first link member constituted by a first section pivotally connected to said tool slide, and a second section in thread engagement with the first section to form a length adjustable structure therebetween; and a second link member having a first end pivoted to the second section of the first link member, and a second end pivoted to the driving shaft so that when the driving shaft is rotated by the respective servo motor, said tool slide is moved within said slide channel by the linkage, said biasing spring having one end attached to the pivotal connection between the first link member of said linkage and said tool slide so that when said tool slide is moved by said linkage, the spring biasing said roller to be contactable by said side block and when said roller is contacted by said side block, said tool holder is rotated about the pivot between the third position and the fourth position thereof.

7. A spring formation apparatus as claimed in claim 1, further comprising a detection device for detecting the length of the spring which is being formed by said apparatus.

8. A spring formation apparatus as claimed in claim 7, wherein said detection device comprises an elongated stand secured on said work table, and a pneumatic cylinder mounted to said stand so as to be movable along a length of said stand, said pneumatic cylinder comprising an axially-movable shaft on which an electrically-conductive probe is mounted, said probe being contactable by the spring which is being formed when the length of the spring reaches a desired value to generate a signal for controlling the feed of the wire.

9. A spring formation apparatus as claimed in claim 1, wherein said wire feed means comprises at least a pair of mated feed rollers disposed inside said housing and driven by a motor to feed the wire through said wire feed passage by a pinching engagement therebetween, said wire feed means further comprising a number of idle rollers to guide the wire.

10. A spring formation apparatus as claimed in claim 1, wherein said apparatus comprises seven linear motion tool sets and a curved motion tool set, each being driven by a respective one of the servo motors.

11. A spring formation apparatus comprising:

a base;

a work table standing on said base in an upright manner, having a front working surface and a rear side opposite to said front working surface, said rear side being enclosed by a housing, said work table having formed thereon a wire feed passage through which a wire used to form a spring of a desired length by said apparatus is fed along a first direction from the rear side of the work table to the front working surface of said work table;

a plurality of servo motors disposed inside said housing each having a respective driving shaft;

a plurality of linear motion tool sets mounted on the front working surface of said work table, each having a linear motion tool slidable on said front working surface along a radial direction extending from the wire feed passage between a first position away from said wire feed passage and a second position close to said wire feed passage, said linear motion tool being engageable with the wire fed through said wire feed passage at the second position;

a curved motion tool set mounted on the front working surface of said work table comprising:

a curved motion tool linearly slidable on said working surface along a radial direction extending from the wire feed passage between a first position away from said wire feed passage and a second position close to said wire feed passage, said curved motion tool being engageable with the wire fed through said wire feed passage at the second position, said curved motion tool being also rotatable about a pivot normal to said front working surface between a third position and a fourth position so as to be movable in a combined motion of linear translation and angular rotation;

a tool seat rotatably mounted on said front working surface about a circular disk member having an axis normal to said front working surface, said tool seat having a slide channel to receive therein a tool slide which is retained within said slide channel by securing plates, said tool slide being slidable within said slide channel along the radial direction thereof;

a tool holder which is rotatably secured to said tool slide to be movable therewith and rotatable relative thereto about a pivot normal to said front working surface, said tool holder having the curved motion tool fixed thereon at a lower end thereof and a roller rotatably attached thereto at an upper end thereof; and a biasing spring being connected between said tool holder and said tool slide to bias said roller to be contactable by a side block secured to said tool seat and thus rotating said tool holder about the pivot to provide the combined motion of linear translation and angular rotation to said curved motion tool, said tool slide being mechanically connected to the driving shaft of the respective servo motor to be driven thereby for moving between the first position and the second position thereof; and a mechanical connection between said tool slide and the driving shaft of the respective servo motor for moving said tool slide between the first position and the second position, comprising a linkage having:

a first link member constituted by a first section pivotally connected to said tool slide, and a second section in thread engagement with the first section to form a length adjustable structure therebetween; and a second link member having a first end pivoted to the second section of the first link member, and a second end pivoted to the driving shaft so that when the driving shaft is rotated by the respective servo motor, said tool slide is moved within said slide channel by the linkage, said biasing spring having one end attached to the pivotal connection between the first link member of said linkage and said tool slide so that when said tool slide is moved by said linkage, the spring biases said roller to be contactable by said side block and when said roller is contacted by said side block, said tool holder is rotated about the pivot between the third position and the fourth position thereof; said servo motors respectively driving said linear motion tools and said curved motion tool by the respective driving shafts thereof, said servo motors being actuatable so as to move said linear motion tools and said curved motion tool between their respective first positions and second positions thereof;

wire feed means for feeding the wire from the rear side of the work table through said wire feed passage and to the front working surface of said work table; and a control unit for controlling the feed of the wire from the rear side of the work table to the front working surface and for controlling the movements of said linear motion tools and said curved motion tool in accordance with a preset procedure and sequence to form the spring from the wire.

12. A spring formation apparatus as claimed in claim 11, wherein said control unit comprises a computerized numeric control unit for controlling the feed of said wire and the actuation of said servo motors in accordance with the pre-set working procedure.

13. A spring formation apparatus as claimed in claim 11, wherein said curved motion tool set comprises a pair of inner-threaded blocks disposed in the proximity of two opposite edges of said tool seat, each inner threaded block having a threaded guiding pin threadedly received therein to have a tip of a respective guiding pin received within a slot formed on each of the opposite edges of the tool seat for adjusting said tool seat in a rotatable manner about said circular disk member.

14. A spring formation apparatus as claimed in claim 11, wherein each of said linear motion tool sets comprises:

a tool seat rotatably mounted on said front working surface about a circular disk member having an axis normal to said front working surface, said tool seat having a slide channel to receive therein a tool slide which is retained within said slide channel by securing plates, said tool slide being slidable within said slide channel along the radial direction thereof; and a tool holder which is secured to said tool slide to be movable therewith, said tool holder having a pivoting block with the linear motion tool fixed thereon and pivotally secured thereto to allow said linear motion tool to rotate relative to said tool holder about a pivoting axis being substantially normal to both the radial direction and the first direction, said tool slide being mechanically connected to the driving shaft of the respective servo motor to be driven thereby for moving between the first position and the second position thereof.

15. A spring formation apparatus as claimed in claim 14, wherein said mechanical connection between said tool slide and the driving shaft of the respective servo motor comprises a linkage having:

a first link member constituted by a first section pivotally fixed to said tool slide, and a second section in thread engagement with the first section to form a -length adjustable structure therebetween; and a second link member having a first end pivoted to the second section of the first link member, and a second end pivoted to the driving shaft so that when the driving shaft is rotated by the respective servo motor, said tool slide is moved within said slide channel by the linkage.

16. A spring formation apparatus as claimed in claim 14, wherein said linear motion tool set comprises a pair of inner-threaded blocks disposed in the proximity of two opposite edges of said tool seat, each inner-threaded block having a threaded guiding pin threadedly received therein to have a tip of a respective guiding pin received within a slot formed on each of the opposite edges of the tool seat for adjusting said tool seat in a rotatable manner about said circular disk member.

17. A spring formation apparatus as claimed in claim 11, further comprising a detection device for detecting the length of the spring which is being formed by said apparatus.

18. A spring formation apparatus as claimed in claim 17, wherein said detection device comprises an elongated stand secured on said work table, and a pneumatic cylinder mounted to said stand so as to be movable along a length of said stand, said pneumatic cylinder comprising an axially-movable shaft on which an electrically-conductive probe is mounted, said probe being contactable by the spring which is being formed when the length of the spring reaches a desired value to generate a signal for controlling the feed of the wire.

19. A spring formation apparatus as claimed in claim 11, wherein said wire feed means comprises at least a pair of mated feed rollers disposed inside said housing and driven by a motor to feed the wire through said wire feed passage by a pinching engagement therebetween, said wire feed means further comprising a number of idle rollers to guide the wire.

20. A spring formation apparatus as claimed in claim 11, wherein said apparatus comprises seven linear motion tool sets and a curved motion tool set, each being driven by a respective one of the servo motors.

* * * * *